US007085528B2

(12) United States Patent
Shintani et al.

(10) Patent No.: US 7,085,528 B2
(45) Date of Patent: Aug. 1, 2006

(54) CLEANING UNIT, PROCESS CARTRIDGE, AND IMAGE FORMING APPARATUS

(75) Inventors: Takeshi Shintani, Kanagawa (JP); Naohiro Kumagai, Kanagawa (JP); Masato Yanagida, Tokyo (JP); Toshio Koike, Kanagawa (JP); Eisaku Murakami, Tokyo (JP); Masanori Kawasumi, Kanagawa (JP); Atsushi Sampe, Kanagawa (JP); Masami Tomita, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 124 days.

(21) Appl. No.: 10/725,402

(22) Filed: Dec. 3, 2003

(65) Prior Publication Data

US 2004/0170455 A1 Sep. 2, 2004

(30) Foreign Application Priority Data

Dec. 3, 2002 (JP) ..... 2002-351533

(51) Int. Cl.
*G03G 21/00* (2006.01)

(52) U.S. Cl. ..... 399/350

(58) Field of Classification Search ..... 399/343, 399/345, 350, 351, 354
See application file for complete search history.

(56) References Cited

U.S. PATENT DOCUMENTS

| | | | | |
|---|---|---|---|---|
| 5,940,661 | A * | 8/1999 | Yagi et al. | 399/174 |
| 6,128,461 | A * | 10/2000 | Yoshikawa | 399/350 |
| 6,311,037 | B1 * | 10/2001 | Hisakuni et al. | 399/350 |
| 6,473,589 | B1 * | 10/2002 | Hisakuni | 399/350 |
| 6,539,189 | B1 | 3/2003 | Yanagida | |
| 6,597,881 | B1 | 7/2003 | Hatori et al. | |
| 6,601,991 | B1 | 8/2003 | Sampe | |
| 6,640,076 | B1 | 10/2003 | Shintani | |
| 6,660,443 | B1 | 12/2003 | Sugiyama et al. | |
| 6,682,866 | B1 | 1/2004 | Sugiyama et al. | |

FOREIGN PATENT DOCUMENTS

| | | |
|---|---|---|
| JP | 5-107994 | 4/1993 |
| JP | 9-218624 | 8/1997 |
| JP | 11-174922 | 7/1999 |

* cited by examiner

*Primary Examiner*—Hoang Ngo
(74) *Attorney, Agent, or Firm*—Oblon, Spivak, McClelland, Maier & Neustadt, P.C.

(57) ABSTRACT

A cleaning unit cleans residual toner on the surface of a rotatable image carrier. The cleaning unit includes a cleaning blade that is in contact with the image carrier in such a manner that amplitude of a waveform at an edge of the cleaning blade is not greater than 40 μm with respect to a downstream side of a direction of movement of the image carrier.

34 Claims, 13 Drawing Sheets

CLEANING UNIT, PROCESS CARTRIDGE, AND IMAGE FORMING APPARATUS

CROSS-REFERENCE TO RELATED APPLICATIONS

The present document incorporates by reference the entire contents of Japanese priority document, 2002-351533 filed in Japan on Dec. 3, 2002.

BACKGROUND OF THE INVENTION

1) Field of the Invention

The present invention relates to an image forming apparatus, like a copying machine, a facsimile, and a printer, that forms an image by an electrostatic copying process. More particularly, the present invention relates to an image forming apparatus that includes a cleaning unit that cleans toner remaining on an image carrier.

2) Description of the Related Art

A charge is applied on a surface of an image carrier in an electrophotographic copying machine and the surface is exposed to thereby form an electrostatic latent image on the surface. A developing unit spreads toner on the surface to thereby develop the image. A transferring unit then transfers the image to a recording medium like a paper. A cleaning unit removes the excess toner (hereinafter, "residual toner") that remains on the surface of the image carrier.

The residual toner may be removed with a rotating brush, with a cleaning blade, or with suction. The cleaning blade has been used widely as it has a simple structure and high efficiency. The cleaning blade is made of an elastic material that includes rubber like urethane elastomer. The urethane elastomer scrapes the image carrier and removes the residual toner on the surface of the image carrier.

However, when the surface of the image carrier is scraped, frictional force is developed between the cleaning blade and the image carrier. Particularly, since an edge of the cleaning blade and the surface of the image carrier are uneven, and moreover, due to presence of foreign matters like toner that is fused, external additive that is separated, paper dust, the cleaning blade vibrates. As a result, a gap is developed between the cleaning blade and the image carrier that causes improper cleaning.

Since a highly accurate image recorded by the image forming apparatus is sought these days, there is a tendency to reduce particle size of toner and to make the toner particles round. If the particle size of toner is small, greater amount of force is required for removing the residual toner on the image carrier by cleaning, and a cleaning unit cannot clean the image carrier properly. If the toner is made round, the toner particles tend to enter between the cleaning blade and the image carrier and the cleaning unit cannot clean the image carrier properly.

To solve the problems, a cleaning blade having improved efficiency is disclosed in Japanese Patent Application Laid-open Publication No. H9-218624. In this cleaning blade, polysiloxane oil having a molecular structure that has at least one reactive part at one terminal is included in the polyurethane elastomer. As a result, it is possible to provide the cleaning blade without bending and stick-slip due to low friction, at a low cost.

A cleaning unit in which the noise due to the vibration of a cleaning blade that scrapes the residual toner on the image carrier after transferring an image, is eliminated, is disclosed in Japanese Patent Application Laid-open Publication No. H5-107994. In the cleaning unit, the cleaning blade that is in pressurized contact with the image carrier is made of a material that has impact resilience in a range of 40 percent to 60 percent at 25° C. As a result, the resonance due to the vibrations of the cleaning blade is eliminated.

An image forming apparatus in which an image with a high quality and durability can be achieved by eliminating problems such as coming off of toner, fusion of toner on surface of the image carrier, noise, abnormal vibrations, and bending of blade, is disclosed in Japanese Patent Application Laid-open Publication No. H11-174922. The image forming apparatus is equipped with a piezoelectric element (vibrations applying unit) that applies vibrations to the cleaning blade. As a result of this, problems such as coming off of toner etc. are eliminated.

However, the cleaning blade, the cleaning unit, and the image forming apparatus disclosed in these patent documents have not been able to control the slipping of toner from the cleaning blade in an environment where the image forming apparatus is to be used, thereby causing improper cleaning. Moreover, the cleaning blade, the cleaning unit, and the image forming apparatus have not been able to prevent improper cleaning in an image forming apparatus that use a round shaped toner having a small particle size.

SUMMARY OF THE INVENTION

It is an object of the present invention to at least solve the problems in the conventional technology.

A cleaning unit according to one aspect of the present invention cleans residual toner on a surface of an image carrier in an image forming apparatus. This cleaning unit includes a cleaning blade that is in contact with the surface of the image carrier, wherein an amplitude of a waveform at an edge of the cleaning blade is not greater than 40 μm with respect to a downstream side of a direction of movement of the image carrier.

The cleaning unit according to the above aspect of the present invention may be integrated with one or more selected from an image carrier, a charging unit that charges a surface of the image carrier uniformly, and an exposing unit that writes a latent image on the surface of the image carrier, to form a process carriage.

The image forming apparatus according to the present invention includes the cleaning unit according to the present invention.

The other objects, features and advantages of the present invention are specifically set forth in or will become apparent from the following detailed descriptions of the invention when read in conjunction with the accompanying drawings.

DETAILED DESCRIPTION

Exemplary embodiments of the present invention are described below while referring to the accompanying diagrams.

Figure 1:
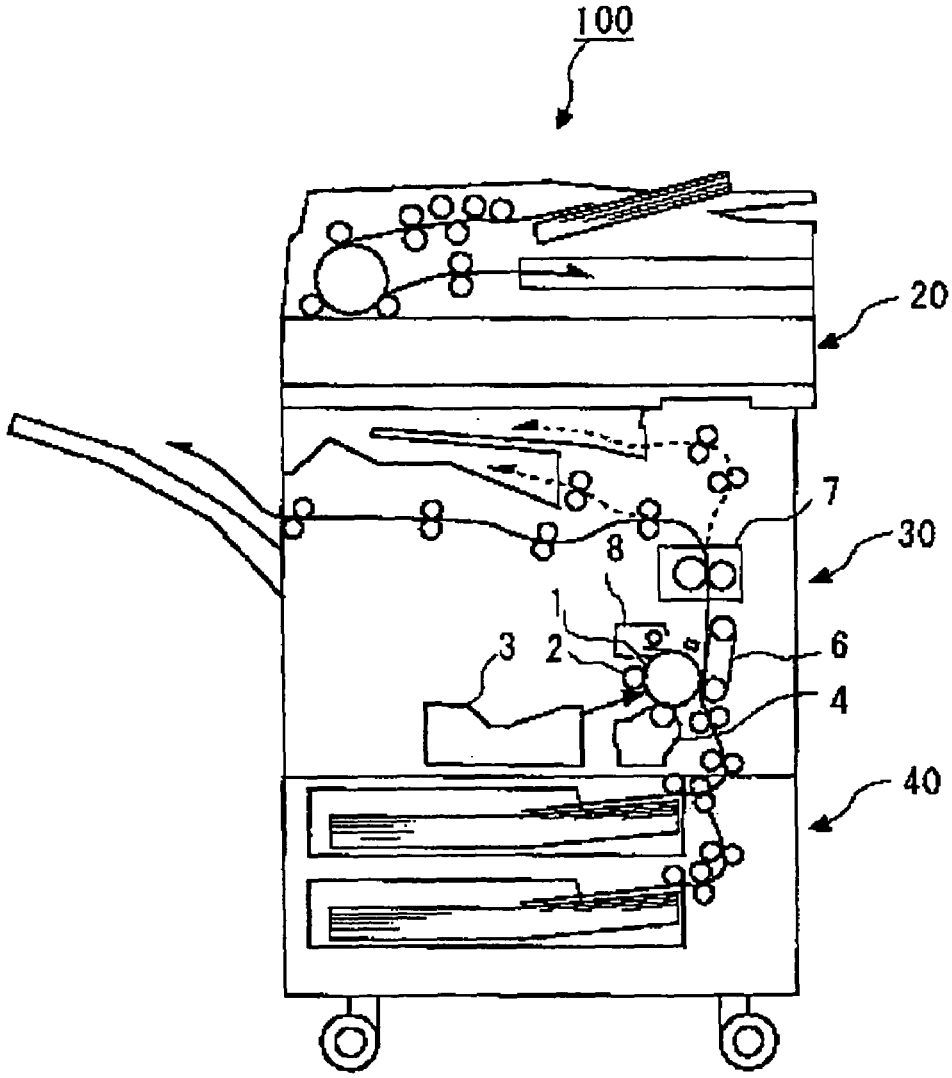
FIG. 1 is a schematic diagram of an image forming apparatus according to an embodiment of the present invention.
Figure 2:
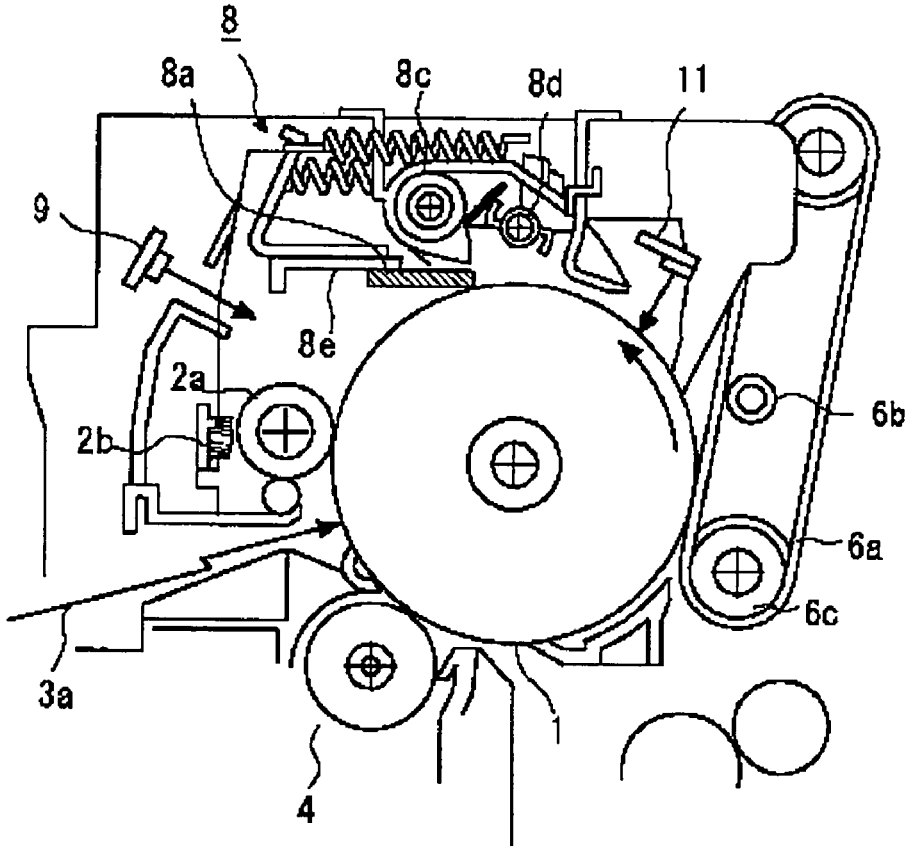
FIG. 2 is a schematic diagram of an area surrounding an image carrier in the image forming apparatus according to the present invention.

FIG. 1 is a schematic diagram of an image forming apparatus according to an embodiment of the present invention. FIG. 2 is a schematic diagram of a structure around an image carrier in the image forming apparatus according to the present invention and depicts contact of a cleaning blade with the image carrier.

The structure around an image carrier 1 includes a charging unit 2, an exposing unit 3, a developing unit 4, a transferring unit 6, a fixing unit 7, and a cleaning unit 8.

The image carrier 1 is made of a photoconductive amorphous metal like amorphous silicon and amorphous selenium or an organic compound like bis azo pigments and phthalocyanine pigments. Considering from the environment and post-treatment point of view, it is desirable to use the organic compound.

The charging unit 2 may employ any one of a corona charging, a roller charging, a brush charging, and a blade charging. The charging unit 2 is assumed here to be the roller charging unit. The charging unit 2 includes a charging roller 2*a*, a cleaning pad 2*b* that is in contact with the charging roller 2*a* for the purpose of cleaning, and a power supply that is in contact with the charging roller 2*a* but is not shown in the diagram. A high voltage is applied on the charging roller 2*a* thereby applying a predetermined voltage between the image carrier 1 and the charging roller 2*a* having a curvature. Corona discharge is generated between the image carrier 1 and the charging roller 2*a*, thereby charging a surface of the image carrier 1 uniformly.

The exposing unit 3 converts data that is read by a scanner in a reading unit 20 and an image signal transmitted from outside like from a PC, which is not shown in the diagram. The exposing unit 3 allows scanning a laser beam 3*a* by a polygon motor and forms an electrostatic latent image on the image carrier 1 based on the image signal that is read through a mirror.

The developing unit 4 includes a developer carrier that carries developer to the image carrier 1, and a toner supplying chamber. The developing unit 4 further includes a cylindrical developer carrier that is disposed in a position such that the cylindrical developer maintains a minute gap with the image carrier 1, and a developer regulator that regulates the amount of the developer on the developer carrier. The developer carrier includes a hollow developer cylinder that is rotatably supported inside the developer carrier and a magnet roll that is fixed to the same shaft inside the hollow cylindrical developer carrier. The developer adheres magnetically on an outer peripheral surface of the developer carrier and is carried further. The developer carrier is formed by a photoconductive and non-magnetic material. A power supply for applying developing bias is connected to the developer carrier. The power supply applies voltage between the developer carrier and the image carrier 1, thereby forming an electric field in an area of developing.

The transferring unit 6 includes a transfer belt 6*a*, a transfer bias roller 6*b* and a tension roller 6*c*. The transfer bias roller 6*b* includes a core of a metal like iron, aluminum, stainless etc. with an elastic layer (a layer of an elastic material) on a surface. To keep a paper in a close contact with the image carrier 1, a pressure necessary on a side of the image carrier 1 is applied on the transfer bias roller 6*b*. Effectiveness of the transfer belt 6*a* depends on a heat resistant material that is selected as a base material of the transfer belt 6*a*. The transfer belt 6*a*, for example, can be made of a seamless polyimide film. On an outer surface of the seamless polyimide film, a layer of fluorine-contained resin can be applied. Moreover, if it is necessary, a layer of silicone rubber may be applied on the polyimide film and a layer of fluorine-contained resin can also be applied. A tension roller is provided on an inner side of the transfer belt 6*a* to drive the transfer belt 6*a* and to apply tension in the transfer belt 6*a*.

The fixing unit 7 includes a fixing roller having a heater for heating a halogen lamp and a pressurizing roller that is in pressed contract. The fixing roller includes a core with an elastic layer (a layer of an elastic material) of 100 μm to 500 μm thickness, desirably of 400 μm thickness on it, and an outer layer of a resin having good mold releasing property like a fluorine-contained resin, to prevent adhesion of toner due to viscosity. The outer resin layer is formed by a PFA tube. Taking into consideration the mechanical deterioration, it is desirable that the thickness of the outer resin layer is in a range of 10 μm to 50 μm. A temperature detector is provided on an outer peripheral surface of the fixing roller and a heater is controlled to maintain almost a constant temperature of about 160° C. to 200° C. on the surface of the fixing roller. The pressurizing roller includes a core having an outer surface covered with a layer of an offset preventing material like tetrafluoroethylene-perfluoroalkyl vinyl ether (PFA) or polytetrafluoro ethylene (PTFE). A layer of an elastic material like silicone rubber may be applied on an outer surface of the core, similar to that in the fixing roller.

The cleaning unit 8 includes a cleaning blade 8*a*, a toner recovery vane 8*d*, a toner recovery coil 8*c*, a support 8*e*, and a toner recovery box that is not shown in the diagram.

The cleaning blade 8*a* cleans residual toner on the image carrier 1 that is left after transferring an image. The cleaning blade 8*a* is made of an elastomer that includes rubber like fluorine rubber, silicone rubber, and urethane rubber. Particularly, urethane elastomer is desirable due to its abrasion and wear resistance, ozone resistance, and contamination resistance. The cleaning blade 8*a* is disposed in the cleaning unit by affixing to the support 8*e*. There is no restriction on material of support 8*e* and it can be made of a material like a metal, plastic, and ceramics. It is desirable to use a metal plate as the support 8*e* since some strength is required to withstand pressure exerted on the support 8*e*. Particularly, it is desirable to use a stainless steel plate, an aluminum plate, and a copper plate of phosphor bronze etc. The cleaning blade 8*a* is affixed to the support 8*e* by applying an adhesive on the support, sticking the blade on it, and fixing it by heating or pressurizing.

Figure 3:
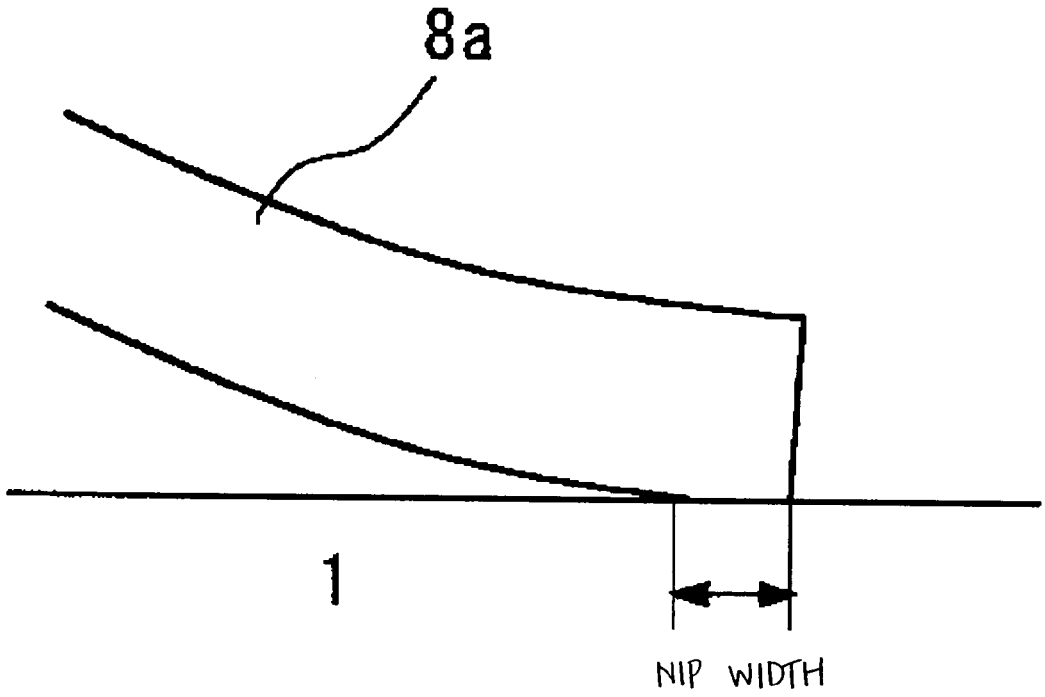
FIG. 3 is an enlarged view of a cleaning blade in contact with the image carrier, depicting a formation of nip width.
Figure 4A:
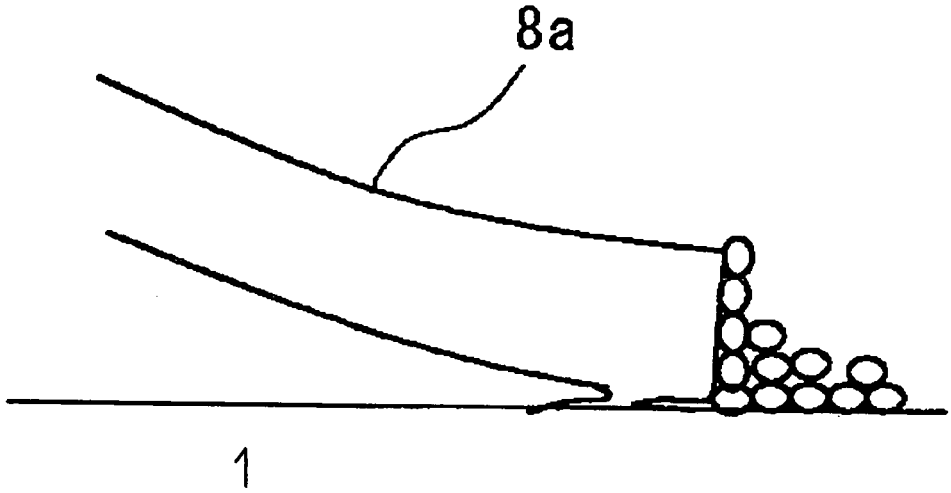
FIG. 4A is a side view of small waveform deformation at an edge of a front tip of the cleaning blade.
Figure 4B:
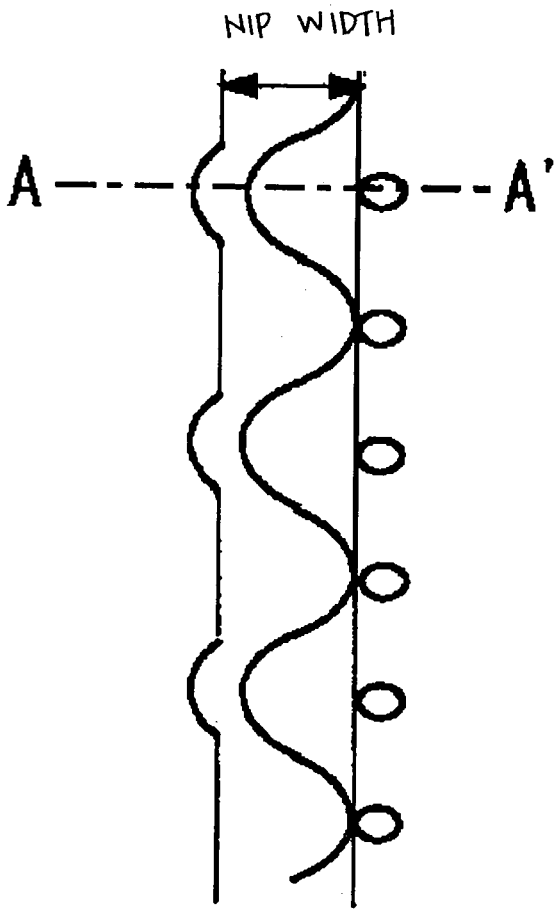
FIG. 4B is a view from beneath of small waveform deformation at the edge of the front tip of the cleaning blade.

FIG. 3 is an enlarged view of nip between the cleaning blade 1 and the image carrier 8*a*. FIGS. 4A and 4B are a side view and a view of the nip. The cleaning blade 8*a* and the image carrier 1 are pressed against each other at a predetermined contact pressure. The pressure distribution when the cleaning blade 8*a* is in contact with the image carrier is such that the pressure exerted by the edge of the front tip of the cleaning blade 8*a* is the maximum. The cleaning blade 8*a* is made of an elastic material and tends to deform. Therefore, with the movement of the image carrier 1, the edge of the cleaning blade deforms in a downstream side of the movement. This results in non-uniform mechanical characteristics due to non-uniformity of internal structure and molecular weight distribution of the cleaning blade 8*a*. Moreover, the surface of the image carrier 1 is uneven. The uneven surface of the image carrier 1 results in non-uniform contact with the cleaning blade 8*a*. Due to the non-uniform mechanical characteristics and the non-uniform contact between the surface of the image carrier 1 and the cleaning blade 8*a*, there is a formation of a waveform at the edge of the cleaning blade. When amplitude of the waveform is small, as illustrated in FIG. 4B, a gap between the cleaning blade 8*a* and the image carrier 1 is small and toner cannot enter into this small gap easily, so that the cleaning is done properly.

Figure 5A:
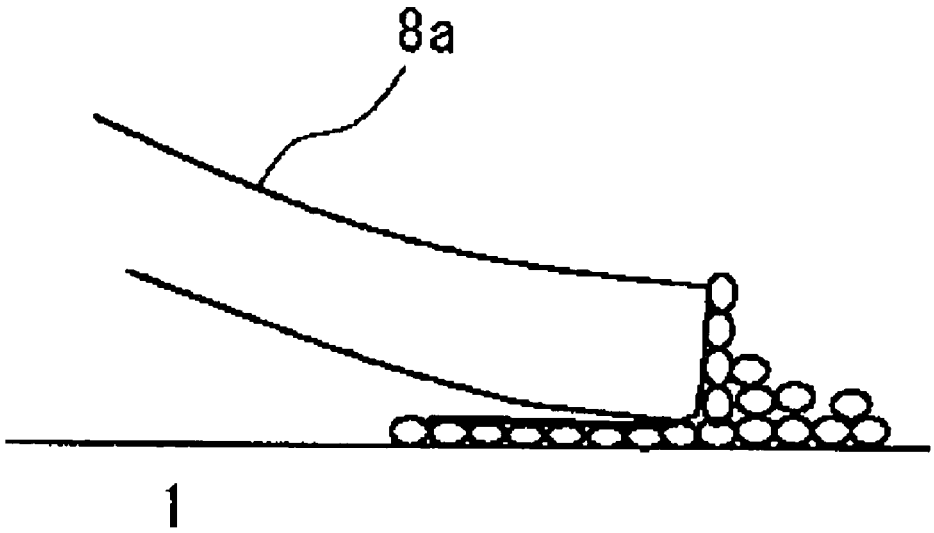
FIG. 5A is a side view of large waveform deformation at an edge of a front tip of the cleaning blade.
Figure 5B:
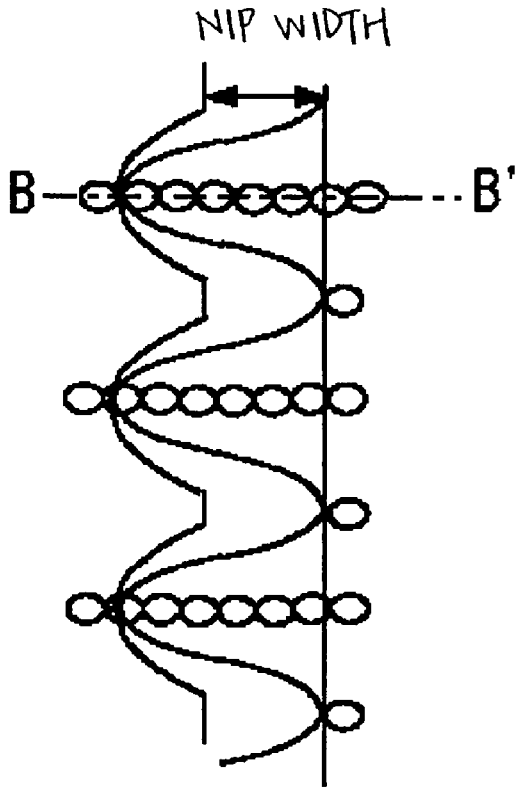
FIG. 5B is a view from beneath of large waveform deformation at the edge of the front tip of the cleaning blade.

FIGS. 5A and 5B are a side view and a view of the nip. When amplitude of the waveform is large, the gap between the cleaning blade 8*a* and the image carrier 1 is large and the toner can enter into this gap easily. Once the toner enters into the gap, the force pushing the toner back becomes ineffective. Moreover, once the toner enters into the gap, the subsequent toner pushes the cleaning blade 8*a* and widens the gap for entering. As a result, toner cannot be cleaned properly. For this reason, the amplitude of the waveform at the edge is adjusted to be not greater than 40 μm. If the amplitude is greater than 40 μm, the gap between the cleaning blade 8*a* and the surface of the image carrier 1 becomes wide and the residual toner cannot be cleaned properly.

A nip width when the cleaning blade 8*a* is in contact with the image carrier 1 in stationary condition is adjusted to be in a range of 5 μm to 30 μm. As it is shown in FIG. 3, since the cleaning blade 8*a* and the image carrier 1 are pressed against each other, the cleaning blade 8*a* undergoes elastic deformation and is in contact with the image carrier 1 with a constant width (which is called as 'nip width'). If the nip width is smaller than 5 μm, when the edge undergoes waveform deformation, even with the small amplitude of the waveform, the toner is pushed by the pressure of the toner on the image carrier 1 and enters the gap between the cleaning blade 8*a* and the image carrier 1, thereby causing improper cleaning. If the nip width is greater than 30 μm, there is an increase in the frictional force between the cleaning blade and the image carrier 1, which causes vibrations in the cleaning blade. As a result, there is a noise like resonance or chattering of the cleaning blade 8*a* and the front tip of the cleaning blade is bent due to rolling over the image carrier 1.

Figure 6A:
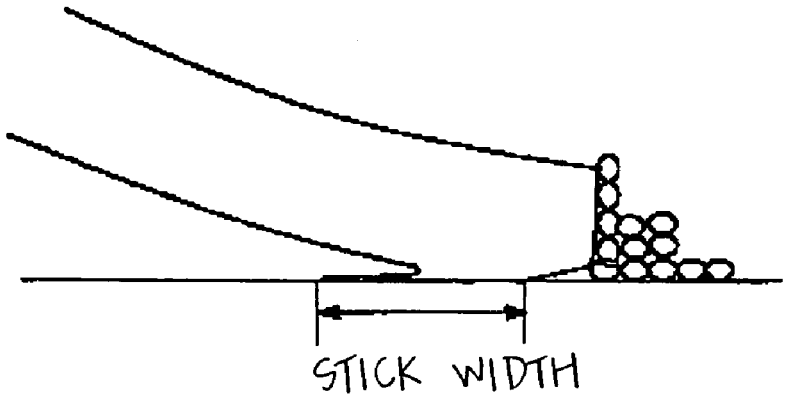
FIG. 6A is a schematic illustration of stick-slip phenomenon depicting the stick.
Figure 6B:
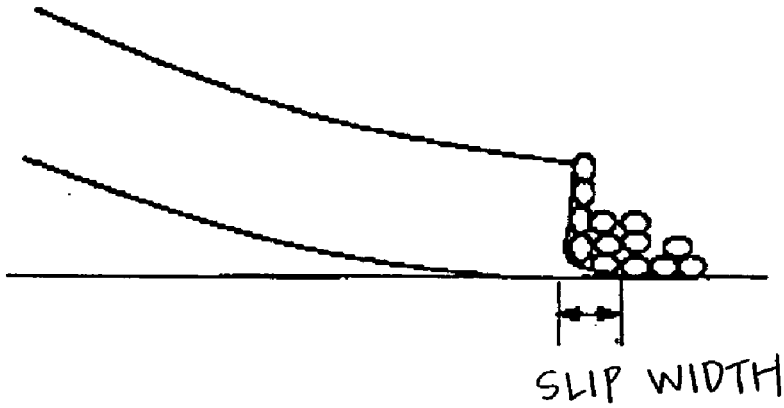
FIG. 6B is a schematic illustration of stick-slip phenomenon depicting the slip.

Not only the edge of the tip of the cleaning blade 8*a* but also the nip width is deformed due to the frictional force between the cleaning blade 8*a* and the image carrier 1. This phenomenon is called as stick-slip. FIGS. 6A and 6B are schematic illustrations of stick-slip phenomenon depicting the stick and the slip respectively. When the cleaning blade 8*a* makes a contact with the image carrier 1 under pressure to clean the toner, the blade deforms due to the force of friction and stress is developed in the cleaning blade 8*a*. If the stress is less than the force of static friction between the cleaning blade 8*a* and the image carrier 1, the cleaning blade 8*a* is stuck to the image carrier and there is no slippage. The nip that is in close contact with the image carrier 1 deforms in a direction of advancement of the image carrier 1. This phenomenon shown in FIG. 6A is called stick. The deformation in the stick is stored as energy in the edge of the cleaning blade 8*a*. If the energy stored becomes greater than the force of friction that is effective in the nip of the cleaning blade 8*a*, this energy becomes effective as a restoring force (impact resilience) and tries to return to original state. This force causes the cleaning blade 8*a* to deform in the opposite direction. This phenomenon shown in FIG. 6B is called slip. The stick and the slip are repeated alternately when the cleaning blade 8*a* is in contact with the image carrier 1 with the nip width and is called as stick-slip phenomenon.

Figure 7A:
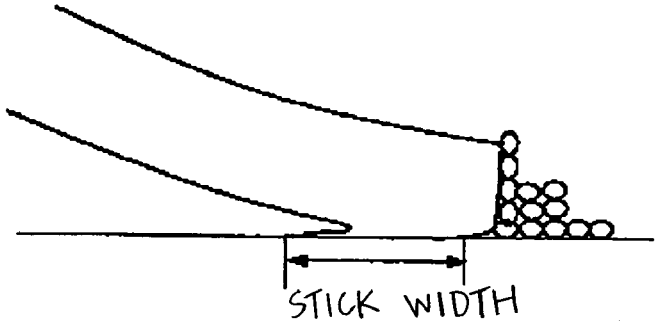
FIG. 7A is a schematic illustration depicting the stick of the cleaning blade when the cleaning is proper.
Figure 7B:
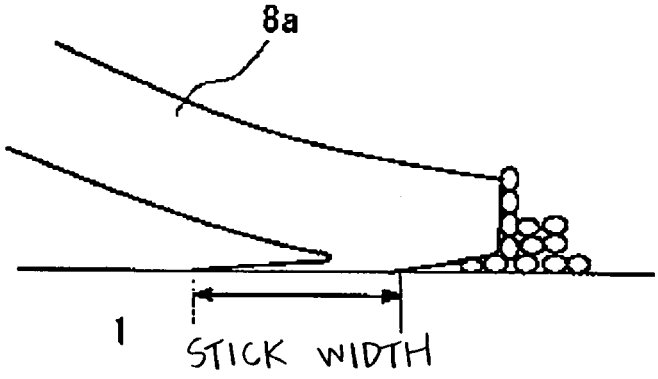
FIG. 7B is a schematic illustration depicting the stick of the cleaning blade when the cleaning is improper.
Figure 7C:
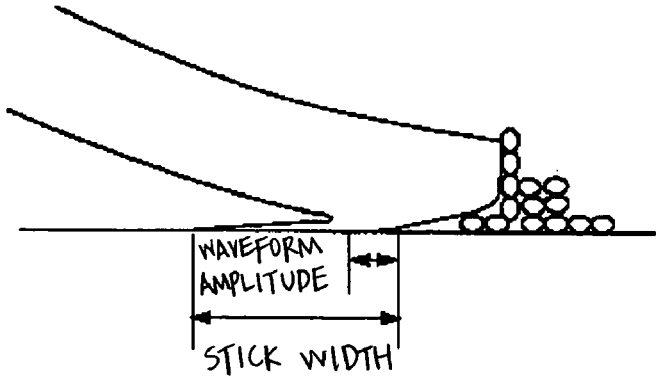
FIG. 7C is a schematic illustration depicting the waveform edge in the stick when the cleaning is improper.

FIGS. 7A and 7B are schematic illustrations depicting the stick of the cleaning blade 8*a* when the cleaning is proper and improper respectively. FIG. 7C is a schematic illustration depicting the waveform edge in the stick when the cleaning is improper. The cleaning capability of the cleaning blade 8*a* is determined in the action of slip by the energy that is stored in the slip. As it is shown in FIG. 7A, when the stick is small, the gap between the cleaning blade 8*a* and the image carrier 1 is small, and the cleaning is proper. If the stick is big, as it is shown in FIG. 7B, due to greater deformation of the cleaning blade 8*a*, there is a gap between the cleaning blade 8*a* and the image carrier 1 and in stick the toner enters into the gap and causes improper cleaning. This may result in breaking of the front tip of the cleaning blade 8*a*. Therefore, the width in the stick is adjusted to be more than 0 μm to give rise to phenomenon of stick and is adjusted to be not greater than 200 μm.

Even in the stick condition, the front tip of the cleaning blade 8*a* vibrates with small amplitude due to variations in the state of contact because of uneven surface of the image carrier 1. The cleaning blade 8*a* vibrates with small amplitude due to non-uniformity of properties like tensile strength and elasticity modulus, and the frictional force developed due to scraping the image carrier. Since the vibrations are in addition to the phenomenon of stick-slip, even the vibrations with the small amplitude result in a gap between the cleaning blade 8*a* and the image carrier 1, thereby causing improper cleaning. If the amplitude of vibrations is greater than 40 μm, the gap between the image carrier 1 and the cleaning blade 8*a* results in improper cleaning. The amplitude of vibrations at the edge of the cleaning blade 8*a* with the stick-slip phenomenon is adjusted to be not greater than 40 μm. When the edge of the cleaning blade 8*a* that is in contact with the image carrier 1 vibrates in a waveform with amplitude greater than 40 μm, if the toner enters into the nip width, unlike the stick condition in which the energy is stored by a big deformation, the toner cannot be pushed back. This results in improper cleaning.

Figure 8:
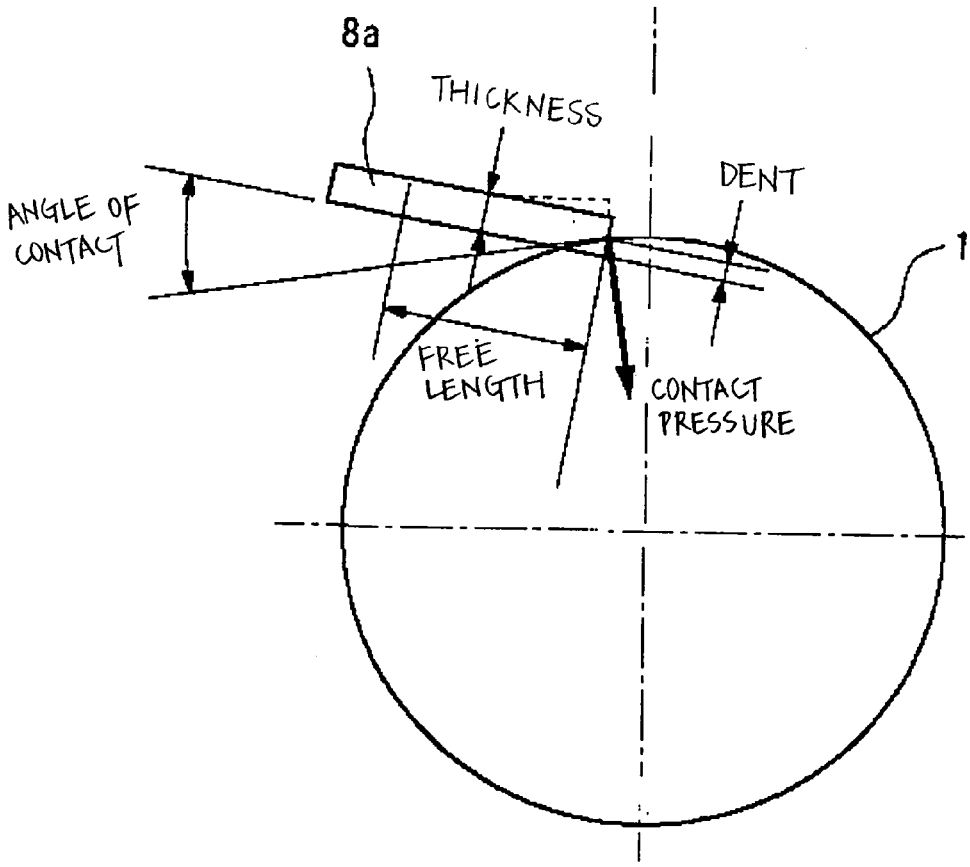
FIG. 8 is a schematic illustration of contact conditions of the cleaning blade.

FIG. 8 is a schematic illustration of contact conditions of the cleaning blade. The cleaning blade 8*a* may be disposed in either counter form (direction against the direction of rotation of the image carrier) or a trailer form (directed in the direction of rotation of the image carrier). Particularly, the counter form is desirable. Even if the contact pressure exerted on the image carrier 1 is low, cleaning capability is good and there is less abrasion of the image carrier 1.

It is desirable that the (JIS-A) of the cleaning blade 8*a* is in a range of 65 to 85 degrees. If the hardness is less than 65 degrees, the deformation of the cleaning blade is more and cleaning of toner becomes difficult. If the hardness is greater than 85 degrees, there is more abrasion of the image carrier 1 and life of the image forming apparatus becomes short. Moreover, for the cleaning blade 8*a* in the cleaning unit according to the present invention, it is desirable that the support 8*e* is either fixed to or integrated with the cleaning blade 8*a* to maintain the angle of contact and the pressure of contact uniform.

Among the contact conditions of the cleaning blade 8*a* in the cleaning unit, it is desirable to have the contact pressure exerted by the cleaning blade 8*a* in a range of 10 gf/cm to 60 gf/cm. If the contact pressure is less than 10 gf/cm, it is difficult to clean toner having a particle size less than 2 μm and if the contact pressure is greater than 60 gf/cm, it results in deterioration of the cleaning capability caused by bending of the tip of the cleaning blade 8*a* or becoming apt to bounding or chattering of the cleaning blade 8*a*.

The width may be adjusted by adjusting the conditions of the material that is used for the cleaning blade 8*a*, like free length, thickness, elasticity modulus.

For example it is desirable to have the elasticity modulus in a range of 4.5 MPa to 10 MPa, the free length of the cleaning blade 8*a* in a range of 5 mm to 12 mm, the thickness of the cleaning blade 8*a* in a range of 1 mm to 2 mm, the angle of contact in a range of 5 degrees to 25 degrees, and a dent on the surface of the image carrier 1 in a range of 0.1 mm to 2.0 mm. It is desirable to have the angle of contact of the cleaning blade 8*a* from a tangent in a range of 5 degrees to 25 degrees. If the angle of contact is less than 5 degrees, it results in tendency of slipping of toner, thereby causing improper cleaning. If the angle of contact is greater than 25 degrees, the cleaning blade is apt to bending during cleaning. It is desirable that the tip of the cleaning blade 8*a* is pressed against the surface of the image carrier 1 such that there is a dent in a range of 0.1 mm to 2.0 mm on the surface of the image carrier 1. If the dent is less than 0.1 mm, an area of contact between the cleaning blade 8*a* and the image carrier 1 is less, thereby allowing the toner to slip through, resulting in improper cleaning. If the dent is more than 2.0 mm, the force of friction with the image carrier 1 is high, thereby making the blade apt to bending and bounding. Moreover, the resonating and chattering of the blade result in improper cleaning. The amplitude of the edge of the cleaning blade 8*a* can also be adjusted by adjusting these contact conditions.

A peak temperature of a loss tangent tan δ of the cleaning blade 8*a* is to be adjusted in a range of −30° C. to 2° C.

Figure 9:
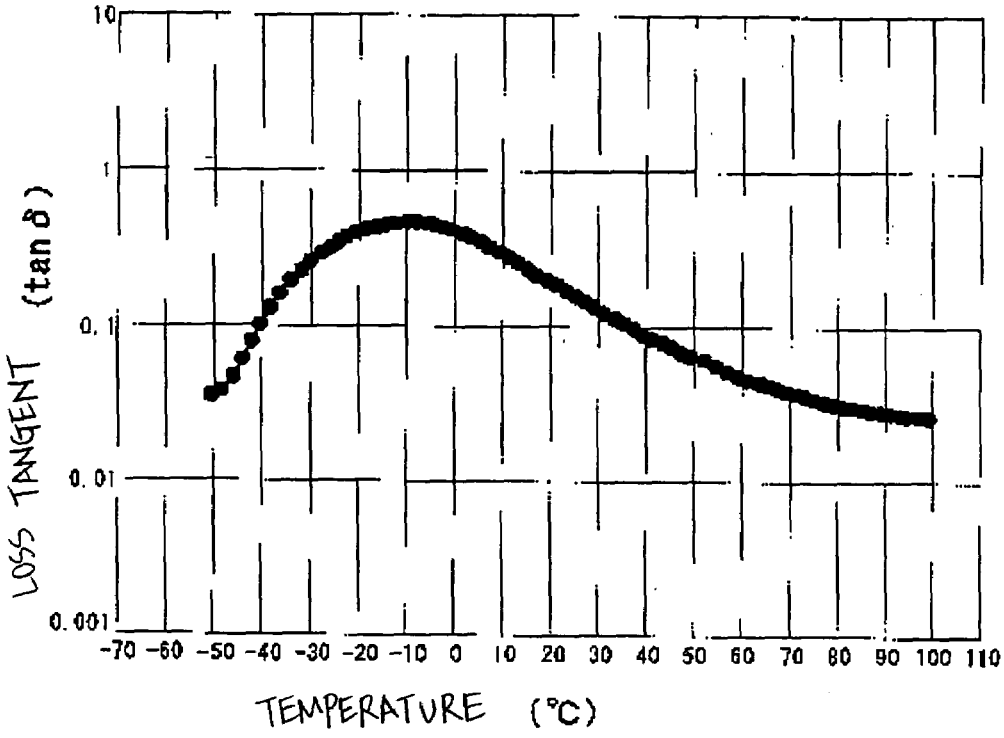
FIG. 9 is a graphical representation of a relationship between temperature and tan 6 of the cleaning blade.

When the cleaning blade 8*a* is imparted sine-wave vibrations of 10 Hz, the peak temperature of the loss tangent (tan δ) is in the range of −30° C. to 2° C. FIG. 9 is a graphical representation of a relation between temperature and tan δ of the cleaning blade. The loss tangent of the cleaning blade 8*a* is a parameter of damping of energy due to an external force when the external force is exerted on the cleaning blade 8*a* and is expressed as a ratio of a loss elasticity modulus and a dynamic elasticity modulus. Particularly, the loss elasticity modulus indicates viscous property and the dynamic elasticity modulus indicates elastic property. The peak temperature of tan δ can be adjusted by varying a resin material, molecular weight, and degree of cross linkage. If the tan δ is small, the elastic property is dominant over the viscous property. As a result, even if the external force is exerted, due to quick recovery of deformed shape of the cleaning blade 8*a*, bending of the blade is suppressed. However, since the blade tends to vibrate easily, it results in resonance and chattering of the cleaning blade 8*a*. If the tan δ is greater, the viscous property is dominant over the elastic property. As a result, the scraping of the image carrier 1 is improved and the vibrations in the cleaning blade are suppressed effectively. The resonating of the cleaning blade 8*a* at high temperature and chattering of the cleaning blade 8*a* at low temperature are minimized, thereby achieving good cleaning capability.

However, it is difficult to fulfill both the properties simultaneously. To improve cleaning capability by improving the close contact of the cleaning blade 8*a* with the image carrier 1, it is desirable that tan δ is not less than 0.01 and tan δ not less than 0.05 is more desirable. So far, the peak temperature of tan δ was kept near the room temperature in most of the cases. However, in the present embodiment, it is possible to adjust tan δ not less than 0.01 in an environment condition that is used practically by adjusting the peak temperature of tan δ not more than 2° C. Thus, the cleaning blade 8*a* having both elastic and viscous properties to some extent, can be used in the practical environment conditions of an image forming apparatus 100.

The cleaning blade 8*a* has a rate of change of tan δ corresponding to temperature in a range of 0.001 to 0.020 per degree centigrade in a range of temperature environment 10° C. to 40° C. in which the image forming apparatus 100 is mostly used. Conditions of the cleaning blade, like free length, thickness, angle of contact with the image carrier, pressure of contact, protrusion are set in an environmental condition in which the cleaning unit is normally used. However, in the cleaning blade 8*a*, which is an elastic body, the movement of molecular chain becomes active with the rise in temperature and the mechanical characteristics of high molecules of the blade change. Therefore, the optimum setting conditions differ according to the temperature. However, the environmental conditions change every moment and it is difficult to adjust the conditions every time. To cope with this, the peak temperature of tan δ is set on low temperature side and the rate of change of tan δ corresponding to the temperature is kept in a range of 0.001 to 0.020, thereby reducing variations in mechanical characteristics due to the change in temperature. If the rate of change of tan δ corresponding to the temperature is greater than 0.020, there is a considerable variation in the mechanical characteristics and the conditions are to be adjusted for high temperature and low temperature. For example, if the conditions are adjusted for low temperature, the blade resonates at high temperature and if the conditions are adjusted for high temperature, the blade chatters at low temperature causing improper cleaning due to the vibrations, thereby resulting in defective image. These characteristics were measured by a dynamic viscosity elasticity measuring equipment (a spectrometer manufactured by IWAMOTO PRECISION EQUIPMENT CO., LTD), and were measured at a frequency of 10 Hz.

The peripheral speed of the image carrier 1 is not less than 180 mm/sec. If the peripheral speed of the image carrier is less than 180 mm/sec, irrespective of the contact conditions including the material of the cleaning blade 8*a*, the cleaning is proper. However, if the peripheral speed of the image carrier 1 increases, there is more deformation of the cleaning blade 8*a* that is in contact with the image carrier 1 and at least one of the amplitude of the waveform of the edge and the stick becomes greater. As a result, there is a tendency of developing a gap between the cleaning blade 8*a* and the image carrier 1 and the toner enters into the gap, thereby making it apt to improper cleaning. Therefore, even if the peripheral speed of the image carrier 1 is not less than 180 mm/sec, since it depends on the contact conditions, the improper cleaning can be minimized.

It is desirable to have the coefficient of static friction not greater than 0.4 and the coefficient of static friction in a range of 0.3 to 0.1 is more desirable. To achieve the suitable value of the coefficient of static friction, the image carrier 1 may be equipped with an applying unit that applies a lubricant or the lubricant may be included in the outer surface of the image carrier 1. If the coefficient of static friction is greater than 0.4, the friction with the cleaning blade 8*a* increases. This results in bending of the blade and resonance due to vibrations. If the coefficient of static friction is less than 0.1, the toner slips through the image carrier 1 and the cleaning blade, and escapes from the cleaning blade.

Figure 10:
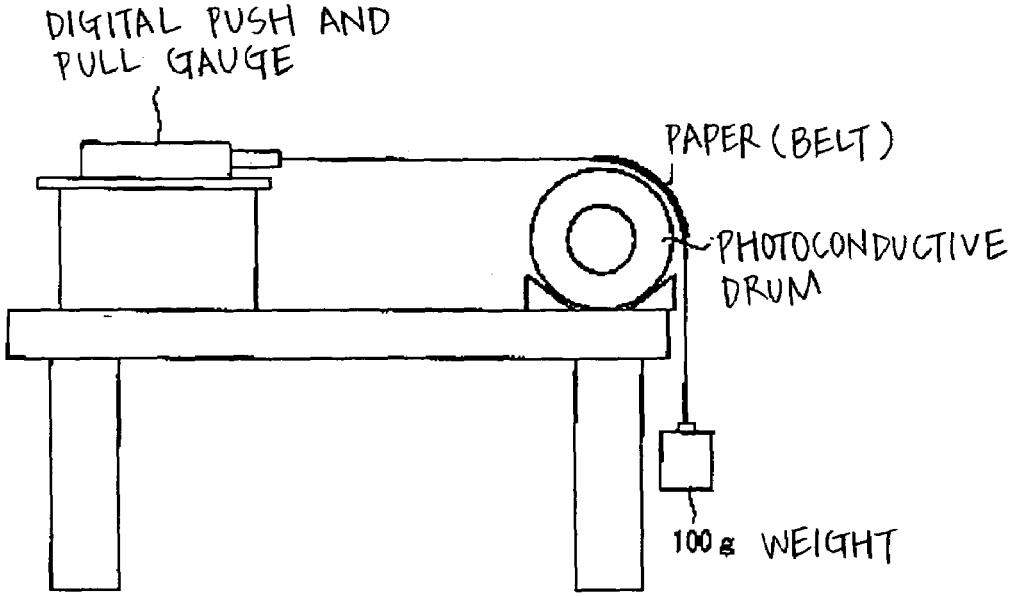
FIG. 10 is an illustration of a method for measurement of coefficient of static friction of the image carrier.

The coefficient of static friction of the image carrier 1 was measured by Euler's belt method as mentioned below. FIG. 10 is an illustration of the method for measurement of the coefficient of static friction of the image carrier. In this case, a good quality paper of medium thickness is stretched as a belt over one fourth of a circumference of the image carrier longitudinally in the direction of pulling. A weight of 98 N (100 gm) is suspended from one side of the belt and a force gauge installed on the other end is pulled. A load when the belt is moved is noted down and substituted in the following formula (1).

$$\text{Coefficient of static friction } \mu = 2/\pi \times 1n\ (F/0.98) \quad (1)$$

(where μ is a coefficient of static friction and F is a measured value)

It is possible to allow to disperse and use a powder and particles of any one of or a plurality of those having different particle size of metal salts of fatty acids like a fluorine resin, a compound of fluorine, carbon fluoride, molybdenum sulfide, zinc stearate as a material for lowering the coefficient of friction. Particularly, the particles of a fluorine resin are desirable. PTFE (polytetrafluoro ethylene) is desirable among these fluorine resins. The molecular structure of PTFE is such that it is perfectly symmetrical high molecule where the $CF_2$ is repeated simply. The symmetry of molecules is such that they are highly non-polar high molecules and the cohesive force between the molecules is extremely weak. The surface of a molecular chain is very smooth. The coefficient of friction is low due to the weak cohesive force between the molecules and less unevenness on surface of the molecular chain. PTFE being very soft and the cohesive force between the molecules being very weak, the molecules of PTFE tend to slip from one another. Due to this sliding, the resistance due to friction of PTFE with many other materials can be reduced. By using PTFE, even if the peripheral speed of the image carrier 1 increases, the stick-slip can be reduced. As a result the improper cleaning can be minimized.

It is desirable to have the volume average particle size of the toner in a range of 3 μm to 10 μm and a range of 3 μm to 8 μm is more desirable. Smaller the particle size, better is the reproducibility of thin lines and a good image quality can be achieved. If the volume average particle size is smaller than 3 μm, the formation of liquid drops becomes difficult, and if the volume average particle size is bigger than 10 μm, the toner prepared by dry pulverization becomes cost effective.

The percentage content of a range of 0.6 μm to 2.0 μm in the number (of particles) distribution of the toner is adjusted to be not less than 10%. If the particle size of the toner becomes small, even if the gap between the cleaning blade 8*a* and the image carrier 1 is minute, the particles enter into the gap easily thereby making it apt to improper cleaning. If the particle size of the toner is smaller than 0.6 μm, irrespective of the contact conditions of the cleaning blade, the cleaning is almost impossible. However, if the toner is having a big particle size, the toner cannot enter easily from the edge of the cleaning blade 8*a*. Thus, the toner having a big particle size functions as an obstacle and suppresses the entering of the toner having a small particle size. As a result, even with the toner having a particle size less than 0.6, the improper cleaning can be minimized. For this reason, the percentage content of number (of particles) in the range of 0.6 μm to 2.0 μm is adjusted to be not less than 10 percent Regarding the particle size distribution, it is desirable that a ratio Dv/Dn of a volume average particle size Dv and a number average particle size Dn is in a range of 1.05 to 1.40. Sharpening the particle size distribution results in making the charging distribution uniform, thereby enabling to achieve a high quality image having reduced excessive concentration of toner at a particular point on the surface of a paper. The ratio of transferring can be improved. The ratio Dv/Dn less than 1.05 is difficult from the manufacturing point of view and a ratio of more than 1.40 results in widening the charging distribution. As a result a high quality image cannot be achieved.

The toner has a degree of circularity such that a shape factor SF-1 is in a range of 100 to 180 and a shape factor SF-2 is in a range of 100 to 190.

Figure 11A:
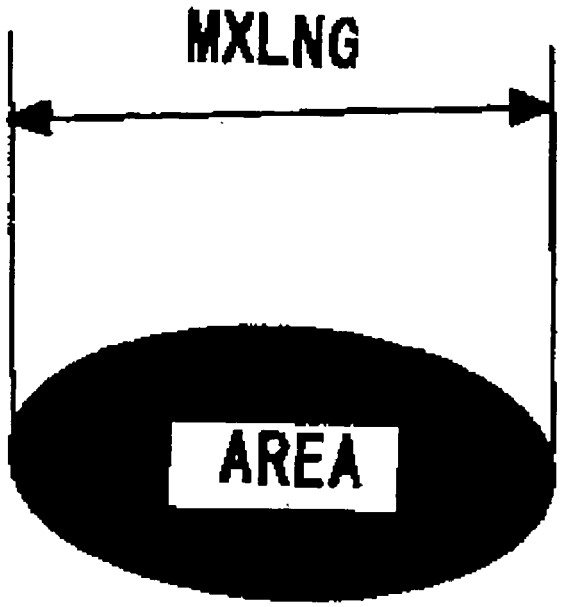
FIG. 11 is an illustration of toner, depicting shape factors SF-1and SF-2.
Figure 11B:
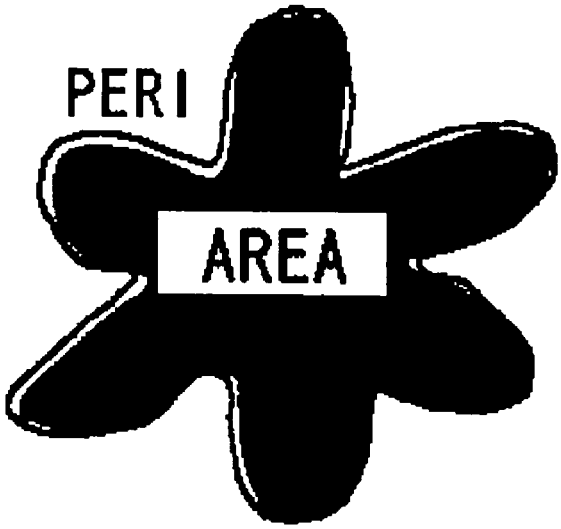

FIG. 11 is an illustration of toner depicting shape factors SF-1 and SF-2. The shape factor SF-1 indicates the proportion of circularity of a toner particle and is represented by the following formula (2). The square of the maximum length MXLNG of the shape obtained by projecting the toner in a two dimension plane is divided by the graphic area AREA and is then multiplied by 100π/4 to obtain the value of the shape factor SF-1.

$$SF\text{-}1 = \{(MXLNG)^2/\text{AREA}\} \times (100\pi/4) \quad (2)$$

When the value of SF-1 is equal to 100, the shape of the toner is perfectly circular and as the value of SF-1 increases, the shape goes on becoming indefinite.

The shape factor SF-2 is a proportion of surface unevenness of the toner and is represented by the following formula (3). The square of the periphery PERI of the shape obtained by projecting the toner in two-dimensional plane is divided by the graphic area AREA and is then multiplied by 100π/4 to obtain the value of the shape factor SF-2

$$SF\text{-}2 = \{(\text{PERI})^2/\text{AREA}\} \times (100\pi/4) \quad (3)$$

When the value of SF-2 is equal to 100, there is no unevenness on the surface of the toner and as the value of SF-2 increases, the surface unevenness of the toner goes on becoming remarkable.

The shape factor was measured by taking a picture of the toner with a scanning electron microscope (S-800 manufactured by HITACHI SEISAKUSHO), analyzing it with an image analyzer (LUSEX3 manufactured by NIRECO CO., LTD.) and calculating the shape factor.

When the shape of the toner particles is closer to the circular shape, the contact of a toner particle with another toner particle or with an image carrier 1 is a point contact, which improves the fluidity of the toner. Thus, the mutual adhesion between the particles is deteriorated and the fluidity is improved, thereby improving the transferring rate. However, the toner particles enter the gap between the cleaning blade 8*a* and the image carrier 1 and the cleaning blade 8*a* can pass easily over the toner particles. For this reason, it is better to have the shape factors SF-1 and SF-2 not less than 100. As the shape factors SF-1 and SF-2 increase, the toner is scattered on the image thereby deteriorating the image quality. For this reason, it is advisable not to have the shape factor SF-1 greater than 180 and the shape factor SF-2 greater than 190.

Any one of a two-component developer consisting of a magnetic carrier and a toner, a magnetic one-component developer, and a non-magnetic one-component developer may be used in the image forming apparatus 100.

It is desirable to have the volume average particle size of the carrier in a range of 20 μm to 100 μm. If the average particle size is smaller than 20 μm, the carrier tends to adhere to the image carrier 1 during developing. If the average particle size is bigger than 100 μm, the carrier cannot be mixed well with the toner and toner is not charged sufficiently, thereby tending to cause improper charging during the continuous use. Although it is desirable that a copper ferrite which includes zinc is used as the magnetic material due to its high saturation magnetization, a suitable magnetic material can be selected according to the process of the image forming apparatus 100. The resins that coat the magnetic carrier are not restricted to any particular resin, and silicone resins, styrene-acrylic resins, fluorine resins, olefin resins are the example. In a method of manufacturing, the coating resin is dissolved in a solvent, sprayed in the fluid bed, and then coated on the core. In another method of manufacturing, the resin particles are allowed to be adhered to nucleons electrostatically and then coated by thermal melting. The thickness of the coated resin is in a range of 0.05 μm to 10 μm and the desirable range of thickness is from 0.3 μm to 4 μm.

Figure 12:
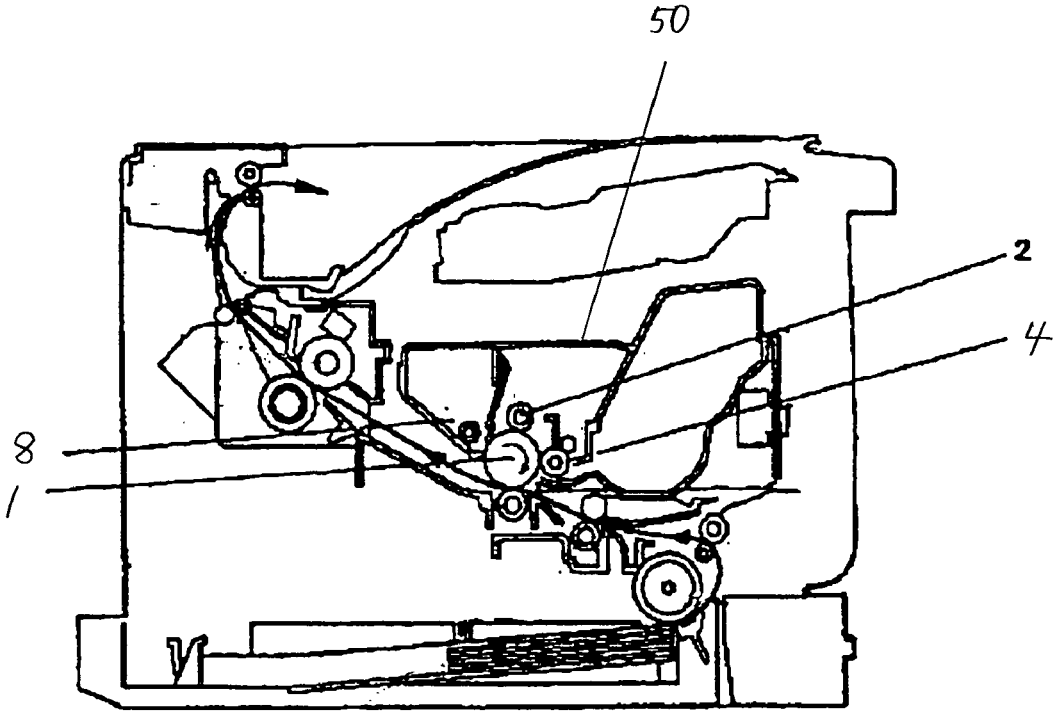
FIG. 12 is an illustration of the image forming apparatus that is equipped with a process cartridge.
Figure 13:
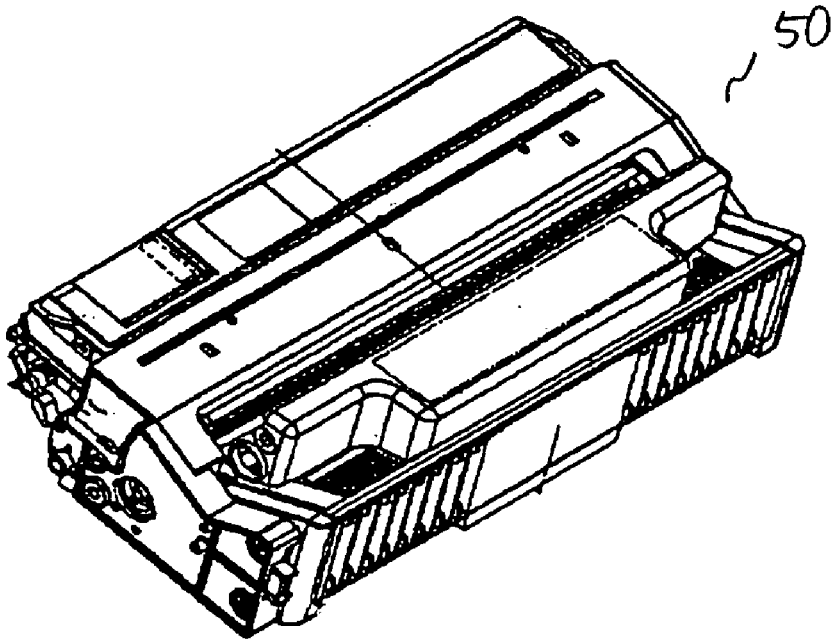
FIG. 13 is an illustration of the process cartridge that is equipped with the cleaning unit.

FIG. 12 is an illustration of the image forming apparatus that is equipped with a process cartridge that includes a cleaning unit, which is integrated with the image carrier, the charging unit, and the developing unit according to an embodiment. FIG. 13 is an illustration of the process cartridge that is equipped with the cleaning unit according to an embodiment. The process cartridge that is illustrated in FIG. 13 is detachably connected to the image forming apparatus as shown in FIG. 12. Description of an arrangement of the cleaning blade being similar to the embodiment mentioned above is not omitted.

As a result of forming the process cartridge, if there is any trouble due to any components or units that are integrated with the process cartridge, just by replacing the processing cartridge, the image forming apparatus can be restored to the original condition in a short time. This enables to facilitate maintenance and shorten the servicing time.

Moreover, by providing the cleaning unit that includes the cleaning blade according to the present embodiment, the cleaning capability of cleaning the electrophotographic photosensitive drum (image carrier) can be improved. This contributes to a longer life of the process cartridge.

According to the present embodiment, the process cartridge that is equipped with the cleaning unit and integrated with the charging unit, developing unit, and the image carrier is made to be detachably connected to the image forming apparatus. However, the present invention is not limited solely to this structure. The present invention is also applicable to a structure in which the cleaning unit, the charging unit and/or developing unit, and the electrophotographic photosensitive drum (image carrier) are integrated and the integrated structure is made to be detachably connected to the image forming apparatus. A process cartridge can also be equipped with the cleaning unit and integrated with at least any one selected from among the charging unit, the developing unit, and the image carrier.

Thus, according to the present invention, it is possible to provide an efficient cleaning unit.

Although the invention has been described with respect to a specific embodiment for a complete and clear disclosure, the appended claims are not to be thus limited but are to be construed as embodying all modifications and alternative constructions that may occur to one skilled in the art which fairly fall within the basic teaching herein set forth.

What is claimed is:

1. A cleaning unit that cleans residual toner on a surface of an image carrier in an image forming apparatus, comprising:

a cleaning blade that is in contact with the surface of the image carrier, wherein an amplitude of a waveform at an edge of the cleaning blade is not greater than 40 μm with respect to a downstream side of a direction of movement of the image carrier.

2. The cleaning unit according to claim 1, wherein a nip width of the cleaning blade is in a range of 5 μm to 30 μm.

3. The cleaning unit according to claim 1, wherein a stick width in a stick-slip phenomenon that occurs when the cleaning blade is in contact with the image carrier is not greater than 200 μm.

4. The cleaning unit according to claim 1, wherein the cleaning blade is in a counter form with respect to rotation of the image carrier and an angle of contact at which the cleaning blade is in contact with the image carrier is in a range of 5 degrees to 25 degrees.

5. The cleaning unit according to claim 1, wherein a hardness of the cleaning blade is in a range of 65 degrees to 85 degrees (JIS-A).

6. The cleaning unit according to claim 1, further comprising an arrangement that presses the cleaning blade and the image carrier toward each other at a pressure in a range of 10 gf/cm to 60 gf/cm.

7. The cleaning unit according to claim 1, wherein a peak temperature of a loss tangent tan δ of the cleaning blade is in a range of −30° C. to 2° C.

8. The cleaning unit according to claim 1, wherein a rate of change of loss tangent tan δ corresponding to a temperature in a range of 10° C. to 50° C., is in a range of 0.001 per degree to 0.020 per degree.

9. A process cartridge in an image forming apparatus, the process cartridge comprising:

a cleaning unit that includes a cleaning blade that is in contact with a surface of an image carrier and that cleans residual toner from the surface, wherein an amplitude of a waveform at an edge of the cleaning blade is not greater than 40 μm with respect to a downstream side of a direction of movement of the image carrier; and at least one selected from an image carrier;

a charging unit that charges a surface of the image carrier uniformly; and an exposing unit that writes a latent image on the surface of the image carrier.

10. The process cartridge according to claim 9, wherein a nip width of the cleaning blade is in a range of 5 μm to 30 μm.

11. The process cartridge according to claim 9, wherein stick width in a stick-slip phenomenon that occurs when the cleaning blade is in contact with the image carrier is not greater than 200 μm.

12. The process cartridge according to claim 9, wherein the cleaning blade is in a counter form with respect to rotation of the image carrier and an angle of contact at which the cleaning blade is in contact with the image carrier is in range of 5 degrees to 25 degrees.

13. The process cartridge according to claim 9, wherein a hardness of the cleaning blade is in a range of 65 degrees to 85 degrees (JIS-A).

14. The process cartridge according to claim 9, further comprising an arrangement that presses the cleaning blade and the image carrier toward each other at a pressure in a range of 10 gf/cm to 60 gf/cm.

15. The process cartridge according to claim 9, wherein a peak temperature of a loss tangent tan δ of the cleaning blade is in a range of −30° C. to 2° C.

16. The process cartridge according to claim 9, wherein a rate of change of loss tangent tan δ corresponding to a temperature in a range of 10° C. to 50° C., is in a range of 0.001 per degree to 0.020 per degree.

17. The process cartridge according to claim 9, wherein a coefficient of static friction of the surface of the image carrier is in a range of 0.1 to 0.4.

18. The process cartridge according to claim 9, comprising the image carrier, wherein a peripheral speed of the rotation of the image carrier is not less than 180 mm/sec.

19. The process cartridge according to claim 9, comprising the developing unit, wherein a volume average particle size of the toner that is supplied by the developing unit to the surface of the image carrier is in a range of 3 μm to 8 μm and percentage content of number of toner in a range of 0.6 μm to 2.0 μm is not less than 10 percent.

20. The process cartridge according to claim 9, comprising the developing unit, wherein a ratio Dv/Dn of a volume average particle size and a number average particle size of the toner that is supplied by the developing unit to the surface of the image carrier is in a range of 1.05 to 1.40.

21. The processing cartridge according to claim 9, comprising the developing unit, wherein a shape factor SF-1 of the toner that is supplied by the developing unit to the surface of the image carrier is in a range of 100 to 180 and a shape factor SF-2 of the toner is in a range of 100 to 190.

22. A image forming apparatus comprising a process cartridge, the process cartridge including a cleaning unit that has a cleaning blade that is in contact with a surface of an image carrier and that cleans residual toner from the surface, wherein an amplitude of a waveform at an edge of the cleaning blade is not greater than 40 μm with respect to a downstream side of a direction of movement of the image carrier; and at least one selected from an image carrier;

a charging unit that charges a surface of the image carrier uniformly; and an exposing unit that writes a latent image on the surface of the image carrier.

23. The image forming apparatus according to claim 22, wherein a nip width of the cleaning blade is in a range of 5 μm to 30 μm.

24. The image forming apparatus according to claim 22, wherein stick width in a stick-slip phenomenon that occurs when the cleaning blade is in contact with the image carrier is not greater than 200 μm.

25. The image forming apparatus according to claim 22, wherein the cleaning blade is in a counter form with respect to rotation of the image carrier and an angle of contact at which the cleaning blade is in contact with the image carrier is in range of 5 degrees to 25 degrees.

26. The image forming apparatus according to claim 22, wherein a hardness of the cleaning blade is in a range of 65 degrees to 85 degrees (JIS-A).

27. The image forming apparatus according to claim 22, further comprising an arrangement that presses the cleaning blade and the image carrier toward each other at a pressure in a range of 10 gf/cm to 60 gf/cm.

28. The image forming apparatus according to claim 22, wherein a peak temperature of a loss tangent tan δ of the cleaning blade is in a range of −30° C. to 2° C.

29. The image forming apparatus according to claim 22, wherein a rate of change of loss tangent tan δ corresponding to a temperature in a range of 10° C. to 50° C., is in a range of 0.001 per degree to 0.020 per degree.

30. The image forming apparatus according to claim 22, wherein a coefficient of static friction of the surface of the image carrier is in a range of 0.1 to 0.4.

31. The image forming apparatus according to claim 22, comprising the image carrier, wherein a peripheral speed of the rotation of the image carrier is not less than 180 mm/sec.

32. The image forming apparatus according to claim 22, comprising the developing unit, wherein a volume average particle size of the toner that is supplied by the developing unit to the surface of the image carrier is in a range of 3 μm to 8 μm and percentage content of number of toner in a range of 0.6 μm to 2.0 μm is not less than 10 percent.

33. The image forming apparatus according to claim 22, comprising the developing unit, wherein a ratio Dv/Dn of a volume average particle size and a number average particle size of the toner that is supplied by the developing unit to the surface of the image carrier is in a range of 1.05 to 1.40.

34. The image forming apparatus according to claim 22, comprising the developing unit, wherein a shape factor SF-1 of the toner that is supplied by the developing unit to the surface of the image carrier is in a range of 100 to 180 and a shape factor SF-2 of the toner is in a range of 100 to 190.

* * * * *